US010264814B2

(12) United States Patent
Kaljura et al.

(10) Patent No.: US 10,264,814 B2
(45) **Date of Patent: *Apr. 23, 2019**

(54) APPARATUS AND METHOD FOR MAKING A SMOKING ARTICLE

(71) Applicant: British American Tobacco (Investments) Limited, London (GB)

(72) Inventors: Karl Kaljura, Southampton (GB); Sanjeev Sharma, Southampton (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 1228 days.

This patent is subject to a terminal disclaimer.

(21) Appl. No.: 13/891,092

(22) Filed: May 9, 2013

(65) Prior Publication Data

US 2013/0239980 A1 Sep. 19, 2013

Related U.S. Application Data

(63) Continuation of application No. 12/993,541, filed as application No. PCT/EP2009/055300 on Apr. 30, 2009.

(30) Foreign Application Priority Data

May 20, 2008 (GB) ..... 0809135.7

(51) Int. Cl.

| | |
|---|---|
| ***A24C 5/00*** | (2006.01) |
| ***A24C 5/47*** | (2006.01) |
| ***A24C 5/58*** | (2006.01) |

(52) U.S. Cl.

CPC ..... *A24C 5/005* (2013.01); *A24C 5/471* (2013.01); *A24C 5/586* (2013.01); *B31F 2201/0733* (2013.01); *B31F 2201/0779* (2013.01)

(58) Field of Classification Search

None

See application file for complete search history.

(56) References Cited

U.S. PATENT DOCUMENTS 3,228,402 A 1/1966 Lebert
3,915,090 A * 10/1975 Horst ..... B31F 1/07 101/181

(Continued)

FOREIGN PATENT DOCUMENTS

CN 2781812 Y 5/2006
DE 3918137 A1 12/1989

(Continued)

OTHER PUBLICATIONS

Office Action with Search Report, issued by State Intellectual Property Office, P.R. China dated Apr. 22, 2015, for Application No. 201210142447.3, filed Apr. 30, 2009 (including English translation).

(Continued)

*Primary Examiner* — Phu N Nguyen
(74) *Attorney, Agent, or Firm* — Cantor Colburn LLP

(57) ABSTRACT

An apparatus for making a smoking article, the smoking article having a rod of smoke able material (15) and a cylindrically wrapped layer of sheet material, comprises a holder (3) for holding sheet material, an embossing unit (8) configured to emboss sheet material drawn from the holder and an assembling station (14) for assembling the smoking article, configured to receive embossed sheet material from the embossing unit and to wrap the embossing sheet material at least partially around a part of the smoking article.

6 Claims, 10 Drawing Sheets

(56) References Cited

U.S. PATENT DOCUMENTS

| | | | | |
|---|---|---|---|---|
| 4,025,373 | A | 5/1977 | Hirsch et al. | |
| 4,361,260 | A * | 11/1982 | Hanlan | B26D 5/34 101/248 |
| 4,583,558 | A | 4/1986 | Luke | |
| 4,928,715 | A | 5/1990 | Mentzel et al. | |
| 5,135,008 | A | 8/1992 | Oesterling et al. | |
| 5,394,895 | A | 3/1995 | Muramatsu | |
| 5,623,952 | A | 4/1997 | Hausler | |
| 6,272,982 | B1 | 8/2001 | Stauffacher et al. | |
| 6,531,016 | B1 | 3/2003 | Weber et al. | |
| 6,676,123 | B2 | 1/2004 | Sahlmann | |
| 2002/0053350 | A1 | 5/2002 | Tani et al. | |

FOREIGN PATENT DOCUMENTS

| | | | | |
|---|---|---|---|---|
| DE | 4302508 | A1 | 8/1993 | |
| DE | 3411511 | C2 | 6/1995 | |
| DE | 102007016653 | A1 | 10/2008 | |
| EP | 0059040 | A1 | 9/1982 | |
| EP | 0162704 | B1 | 11/1985 | |
| EP | 0409531 | A2 | 1/1991 | |
| EP | 0724846 | A1 | 8/1996 | |
| EP | 1421863 | A1 | 5/2004 | |
| EP | 1466535 | A1 | 10/2004 | |
| EP | 1475003 | A1 | 11/2004 | |
| EP | 1698450 | A1 | 9/2006 | |
| GB | 852309 | | 10/1960 | |
| GB | 864247 | A | 3/1961 | |
| GB | 2090117 | A | 7/1982 | |
| GB | 2199726 | A | 7/1988 | |
| GB | 2199726 | A * | 7/1988 | A24C 5/38 |
| GB | 2264038 | A | 8/1993 | |
| JP | 2003225989 | A | 8/2003 | |
| RU | 2200673 | C2 | 3/2003 | |
| RU | 2267973 | C2 | 1/2006 | |
| RU | 2006118709 | A | 12/2007 | |
| WO | 01/60730 | A2 | 8/2001 | |
| WO | 2005049326 | A1 | 6/2005 | |

OTHER PUBLICATIONS

Office Action dated Aug. 27, 2013 for corresponding Russian Patent Application No. 2012 122 075. [With translation English].

Office Action issued by State Intellectual Property Office of People's Republic of China on Dec. 9, 2013, for Application No. 201210142447.3, filed Apr. 30, 2009 (including English translation).

Supplemental Search Report dated Dec. 9, 2013, by State Intellectual Property Office of People's Republic of China for Application No. 201210142447.3, filed Apr. 30, 2009.

International Search Report and Written Opinion, dated Oct. 29, 2009, for International Application PCT/EP2009/055300, filed Apr. 30, 2009.

Hamburg-Bahrenfeld, "Final Report on Embossing and Perforating Cigarette Paper," Scientific Department of BAT, Hamburg, dated Jan. 20, 1961.

Luke, J.A., "Thermal Making of Cigarette Tips," Oct. 10, 1983.

Newsome, R.W., Philip Morris U.S.A. Inter-Office Correspondence—Embossing Program, dated Aug. 21, 1987.

International Preliminary Report on Patentability, dated Nov. 23, 2010, for International Application PCT/EP2009/055300, filed Apr. 30, 2009.

European Search Report and European Search Opinion, dated Jul. 17, 2012, for EP Application No. 12160887.1, filed Apr. 30, 2009.

* cited by examiner

APPARATUS AND METHOD FOR MAKING A SMOKING ARTICLE

CLAIM FOR PRIORITY

This application is a continuation of and claims the benefit of 35 U.S.C. § 120 to U.S. patent application Ser. No. 12/993,541, filed Mar. 18, 2011, which in turn claims priority under 35 U.S.C. §§ 365 and 371 to corresponding PCT Application No. PCT/EP2009/055300, titled "Apparatus and Method for Making a Smoking Article," filed Apr. 30, 2009, which in turn claims priority to GB application number 0809135.7, filed May 20, 2008. The entire contents of the aforementioned applications are herein expressly incorporated by reference.

FIELD OF THE INVENTION

This invention relates to a method and apparatus for making a smoking article.

As used herein, the term "smoking article" includes smokeable products such as cigarettes, cigars and cigarillos whether based on tobacco, tobacco derivatives, expanded tobacco, reconstituted tobacco or tobacco substitutes and also heat-non-burn products.

BACKGROUND

A smoking article such as a cigarette may include one or more cylindrically wrapped layers of sheet material.

It has been proposed to make a cigarette having an embossed layer of sheet material. In order to make such a cigarette, a cigarette making machine would include a bobbin which is wound with embossed sheet material. However, such a cigarette making machine would have the disadvantage that the embossed sheet material may be crushed or damaged on the bobbin. Furthermore, the embossed sheet material may be crushed or damaged by rollers or by other components of the machine.

The present invention provides an alternative approach for making a smoking article having embossed sheet material in an apparatus for making smoking articles.

SUMMARY OF THE INVENTION

The present invention provides an apparatus for making a smoking article having a rod of smokeable material and a cylindrically wrapped layer of sheet material, the apparatus comprising a holder for holding sheet material, an embossing unit configured to emboss sheet material drawn from the holder and an assembling station for assembling the smoking article, the assembling station being configured to receive embossed sheet material from the embossing unit and to wrap the embossed sheet material at least partially around a part of the smoking article.

The sheet material may be tipping paper.

As used herein, the term "tipping paper" includes any material suitable for attaching a filter to the rod of smokeable material and therefore includes any suitable type of paper, metallic foil, or cellulose based material.

Accordingly, the sheet material may comprise a cellulose based material, and may be paper. Alternatively, however, sheet material made from such a cellulose based material may be manufactured in the same manner as the manner in which plastic is manufactured.

The assembling station may be configured to assemble the smoking article by joining a filter to the rod of smokeable material by wrapping the filter rod at least partially with the embossed sheet material.

The assembling station may be configured to assemble a pair of smoking articles, each having a rod of smokeable material, by joining the filter rod to the pair of rods of smokeable material by wrapping the filter rod at least partially with the embossed sheet material and cutting the wrapped filter rod.

The sheet material may be a cigarette wrapper. For example, the sheet material may be a cigarette paper suitable for wrapping around the rod of smokeable material.

The assembling station may be configured to wrap the embossed sheet material around the rod of smokeable material.

The sheet material may have a print pattern thereon and the embossing unit may be configured to form an embossed pattern on the sheet material. The apparatus may further comprise a controller configured to bring the print pattern and the embossed pattern into register.

The apparatus may further comprise a positioning unit configured to position the sheet material in so embossing position. The embossing unit may be configured to form an embossed pattern on the sheet material after the sheet material is positioned in the embossing position. The embossing position may be determined so that the print pattern and the embossed pattern are in register.

The registration process may, for example, be implemented as part of a control loop for controlling the machine, or may alternatively, or in addition, be implemented on start up of the machine.

The apparatus may further comprise a detector for detecting a position of the print pattern and the controller may be configured to determine the embossing position in dependence on the detected position of the pattern.

The controller may be configured to send a signal to the positioning unit and thereby control the positioning unit to position the sheet material in the embossing position.

The apparatus may further comprise a tensioning unit for adjustably fixing the sheet material tension at a required level.

The apparatus may further comprising a conveyor for conveying the sheet material through the apparatus.

The positioning unit may comprise a registration toiler driven by a motor.

The controller may be configured to determine whether the detector has detected a change, and display an error message f the detector has not detected a change.

The controller may be configured to determine whether the print is within tolerance and reject a cigarette if the print is not within tolerance.

The embossing unit may comprise an embossing roller.

The embossing unit may have a section which does not emboss or drive. The positioning unit may position the print pattern relative to the embossed pattern formed by the embossing unit by advancing or retarding the print pattern when the embossing unit is not embossing. Thus, the positioning unit may be configured to position the sheet material in the embossing position when the embossing unit us not embossing.

The sheet material may be wrapped around the filter rod such that a first region of the tipping paper overlaps with a second region of the tipping paper. The machine may be arranged such that the second region is not embossed. For example, the sheet material may be arranged such that the embossing unit does not form an embossed pattern on the second region. Alternatively, or in addition, the section which does not emboss may be arranged such that the embossing unit does not form an embossed pattern on the second region.

The apparatus may further comprise a cutting unit for cutting the tipping paper. The cutting unit may comprise a knife drum and a vacuum drum and the vacuum drum may rotate faster than the knife drum.

According to the invention, there is provided a method for making a smoking article in a smoking article making apparatus, the smoking article having a rod of smokeable material and a cylindrically wrapped layer of sheet material, the method comprising a step of embossing, at an embossing unit, sheet material drawn from a holder and a step of assembling the smoking article, wherein assembling the smoking article comprises a step of wrapping embossed sheet material received from the embossing unit at least partially around a part of the smoking article.

The sheet material may be tipping paper.

The sheet material may comprise a cellulose based material.

A filter rod may be joined to the rod of smokeable material by wrapping the filter rod at least partially with the embossed tipping paper.

A filter rod may be joined to a pair of rods of smokeable material by wrapping the filter rod at least partially with the embossed sheet material. The wrapped filter may be cut, thereby forming a pair of smoking articles.

The embossed sheet material may be wrapped around the rod of smokeable material.

The sheet material may include a print pattern thereon and the method may further comprise steps of embossing an embossed pattern on the tipping paper and bringing the print pattern and the embossed pattern into register.

BRIEF DESCRIPTION OF THE DRAWINGS

In order that the invention may be more fully understood, embodiments thereof will now be described by way of illustrative example with reference to the accompanying drawings, in which.

DETAILED DESCRIPTION

Figure 1:
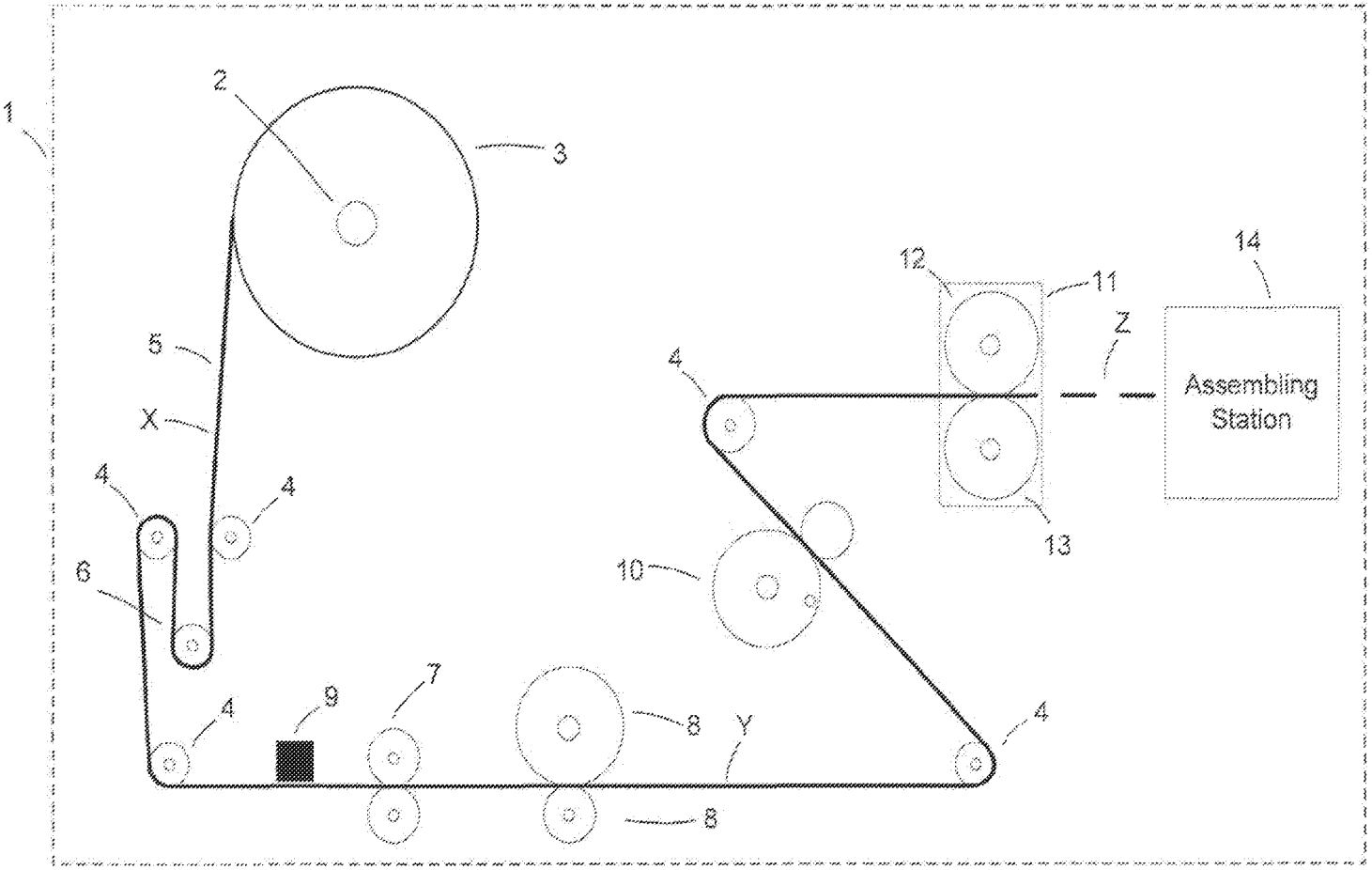
FIG. 1 shows a machine for making a smoking article, the machine having an embossing unit.

Referring to FIG. 1, a machine 1 for making a smoking article in the form of a cigarette includes a holder 2 in the form of a bobbin holding a reel 3 of tipping material web. Conveying rollers 4 are arranged to convey the tipping material web in the form of a tipping paper ribbon 5 from the reel 3 through the machine 1 where individual segments are cut from the ribbon and each used to form a pair of cigarettes. The assembling station 14 uses the tipping paper segment to attach a double length filter to a pair of tobacco rods and subsequently cuts the double length filter to form the cigarette pair.

Figure 2:
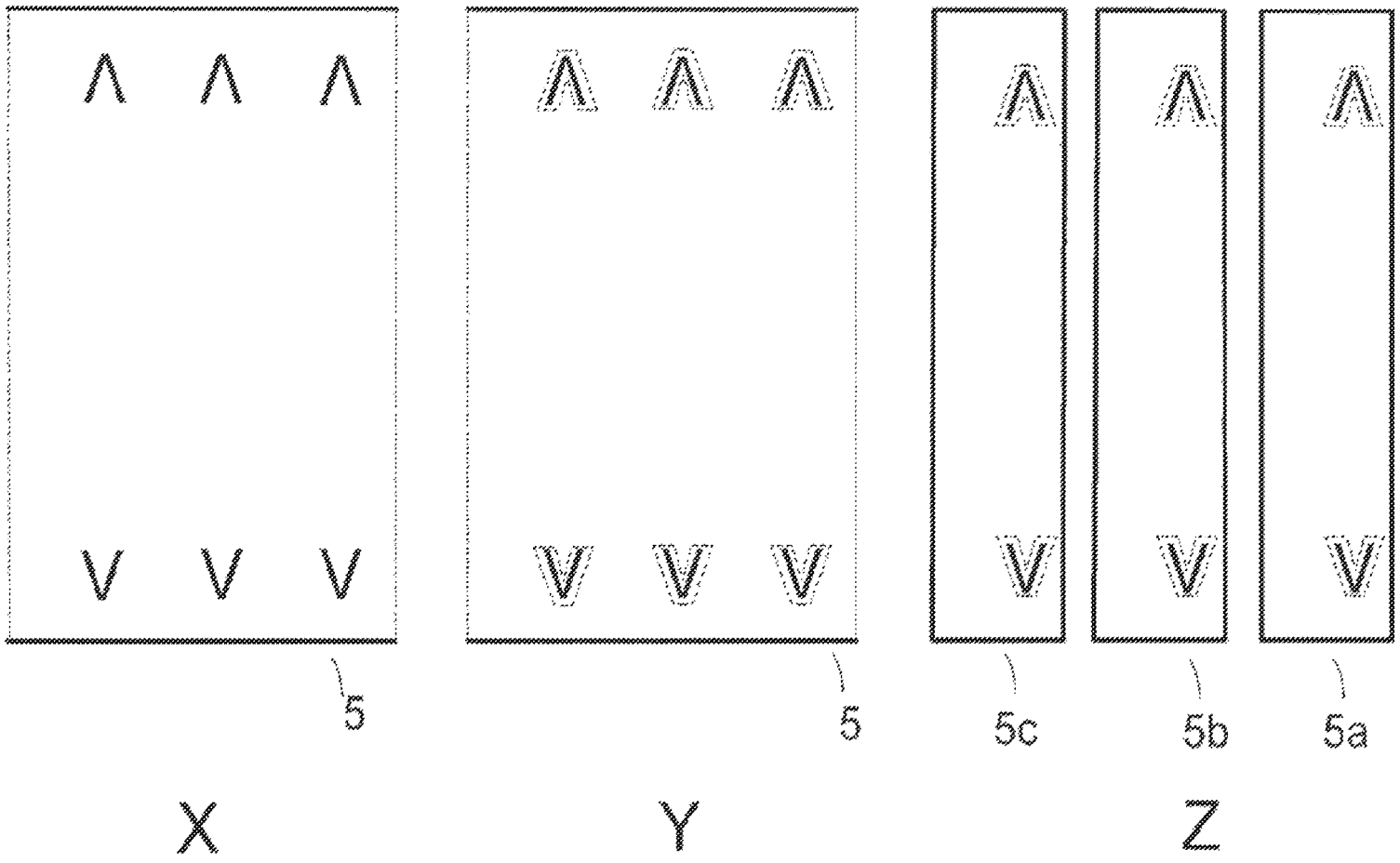
FIG. 2 shows a tipping paper at different stages of processing.

The tipping paper 5 may be pre-printed with printing or a patter. The pattern on the tipping paper may include a plurality of logos associated with a particular brand of cigarette. FIG. 2 illustrates a section of the tipping paper ribbon 5 at location 'X' in FIG. 1. Referring to FIG. 2, at location 'X' the lower section of the tipping paper is printed with a pattern comprising a plurality of identical 'V' logos that are equally spaced along the ribbon. The upper section of the of the tipping paper is printed with a pattern which is a mirror image of the pattern printed on the lower section. As explained in more detail hereinafter, the individual segments of tipping paper cut from the ribbon 5 each include a pair of logos for use in the assembly of a pair of filter cigarettes.

The machine 1 includes a tensioning arm 6 which is arranged to adjustably fix the tipping paper tension at a required level.

The machine 1 includes registration rollers 7 which may draw the tipping paper ribbon 5 from the holder 2 and which may be driven by a motor (not shown) such as a servo motor. The motor may be controlled by a controller that will be described hereinafter with reference to FIG. 4. The registration rollers 7 may retard or advance the tipping paper, and may therefore position the tipping paper 5 in any desires position. The registration rollers may also serve as drive rollers, and may drive other components of the machine.

The machine 1 includes an embossing unit that includes a pair of embossing rollers 8 which are arranged to form an embossed pattern on the tipping paper. One or both embossing rollers may be engraved with one or more patterns so as to form an embossed pattern on tipping paper as it is passed between the rollers. The embossing roller speed may be determined by machine speed, registration roller speed, or drive roller speed. The embossing rollers may be fitted in place of the usual tipping paper pulling rollers of a conventional cigarette making machine.

One of the embossing rollers 8 has a peripheral section which does not emboss. The section which does not emboss is arranged such that is does not contact the tipping paper during rotation of the rollers. Accordingly, when the rotational position of the embossing roller is within a predetermined range, the embossing roller does not make contact with the tipping paper. Thus, the registration rollers can adjust the tipping paper position without the paper contacting the embossing roller, and may thereby adjust the tipping paper position independently of the rotation of the embossing roller. Therefore, the registration rollers can position the print pattern relative to the embossed pattern formed by the embossing roller by advancing or retarding the print pattern when the embossing rollers are not embossing. Although the section which does not emboss has been described above as being disposed on one of the embossing rollers, each of the embossing rollers 8 may have a section which does not emboss.

The machine 1 includes a photocell 9 for detecting the location or position of a printing or pattern on the tipping paper, in this instance, a V logo or 'V' logo pair preprinted on the ribbon 5.

The controller, or other means, may determine an embossing position of the tipping paper in dependence on the detected location or position of the pattern on the tipping paper. The embossing position is determined such that tipping paper in the embossing position is embossed with a pattern in register with the printing or pattern on the tipping paper. FIG. 2 illustrates a section of the tipping paper 5 at location 'Y'. Referring to FIG. 2, at location 'Y' the ripping paper is embossed with a pattern in register with the pattern printed on the tipping paper, the embossed pattern being shown in dotted outline. In particular, referring to FIG. 2, an embossed symbol has been formed in register with each printed symbol on the tipping paper.

The machine 1 also includes gummer rollers 10 for applying glue to the tipping paper to prepare it for attachment to the filters and tobacco rods that are assembled into cigarettes.

The machine 1 also includes a cutting unit 11 for cutting the tipping paper ribbon 5 into segments 5*a*, 5*b*, 5*c* etc for use in attaching filters to individual cigarettes. The cutting unit 11 comprises a knife drum 12 and a vacuum drum 13. In operation, the vacuum drum may rotate faster than the knife drum to ensure that cut tipping paper is taken away before the next piece is cut. A gearing mechanism, coupled to the drums, may be employed to achieve the required difference in rotational speed. The cutting speed may be determined from the machine speed, registration roller speed or drive roller speed. Thus, the cutting speed and the embossing roller speed may be interdependent. Encoder information may be sent to the controller in order to adjust servo speeds to ensure correct offset with the cutter. The controller may be configured to control the cutting unit such that each cut piece of tipping paper has a single printed sub-pattern and a single embossed sub-pattern. FIG. 2 illustrates a section of the tipping paper 5 at location 'Z'. Referring to FIG. 2, at location 'Z' the tipping paper is cut such that each segment 5*a*, 5*b*, 5*c* of tipping paper has an embossed 'V' symbol pair in register with a printed 'V' symbol pair.

Figure 3:
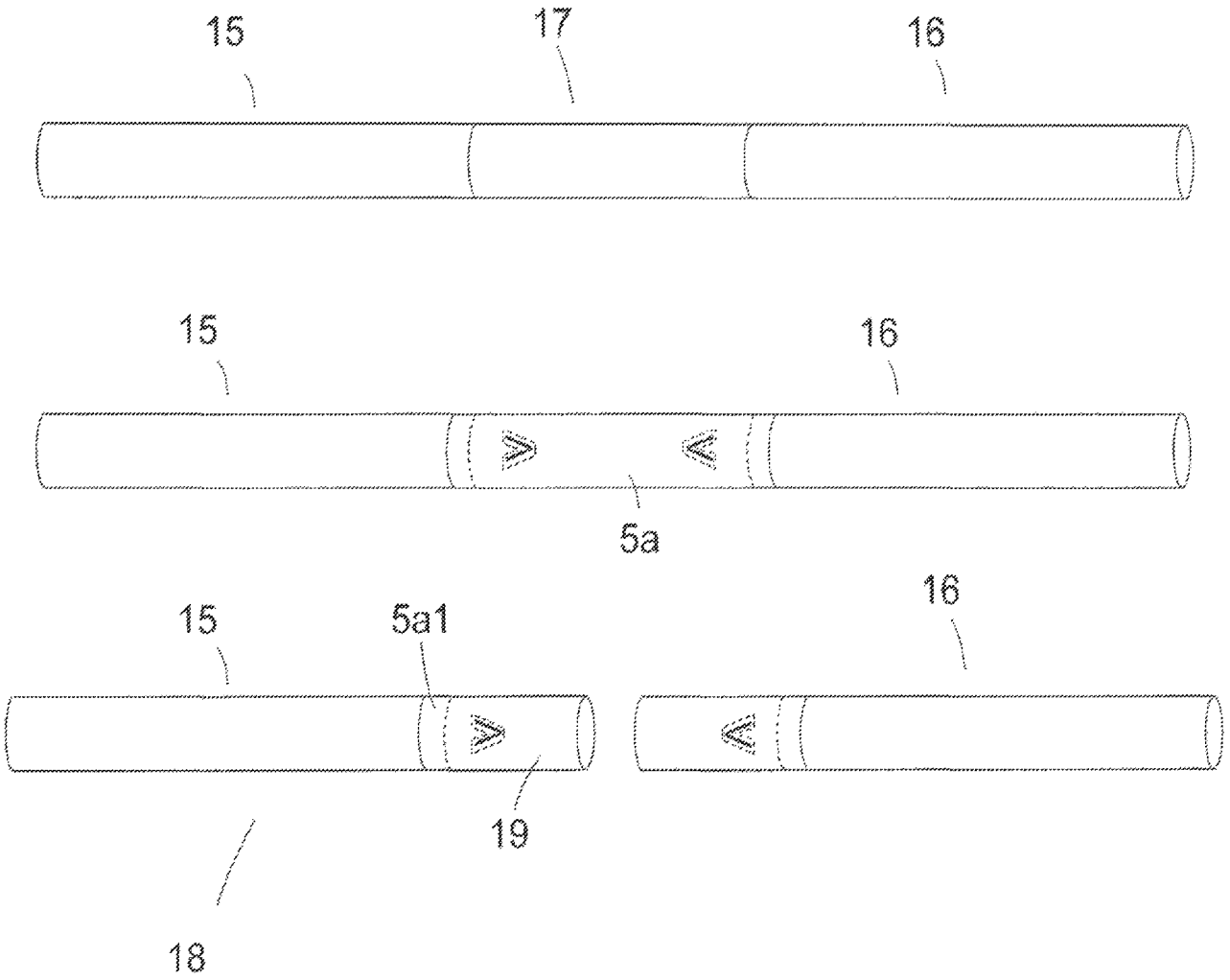
FIG. 3 shows various stages of cigarette manufacture.

The cigarette making machine also includes an assembling station 14 configured to assemble cigarettes. Referring to FIG. 3, the assembling station successively axially aligns a first paper wrapped tobacco rod 15, a second paper wrapped tobacco rod 16 and a double length filter 17 between drive rollers (not shown) and wraps them with one of the glue coated segments 5*a* of the embossed tipping paper to join them together. The wrapped double length filter is then cut, thereby forming a pair of assembled cigarettes. Such assembling stations are well known per se and will not be described in detail herein.

An assembled cigarette 18 this comprises a filter 19, a rod of generally cylindrically paper wrapped tobacco 15 and a generally cylindrically wrapped segment of tipping paper 5*a*1. The segment 5*a*1 is thus glued to the periphery of the filter 19, which may comprise a tow of cellulose acetate material wrapped with a plugwrap (not shown). As shown, the segment of tipping paper 5*a*1 overlaps the end of the tobacco rod where it abuts the filter 19 and is glued thereto so as to hold the filter and tobacco rod together. The tipping paper 5*a*1 is printed with a 'V' symbol and is embossed with a 'V' symbol in register with the printed symbol.

The described cigarette making machine has the advantage that embossing of the logo on the tipping paper 5 is carried out as the ribbon unwinds from the bobbin 2 with the advantage that the embossing is not crushed by the tension of the ribbon in the bobbin, as would occur if the ribbon was pre-embossed before being wound on to the bobbin.

Figure 4:
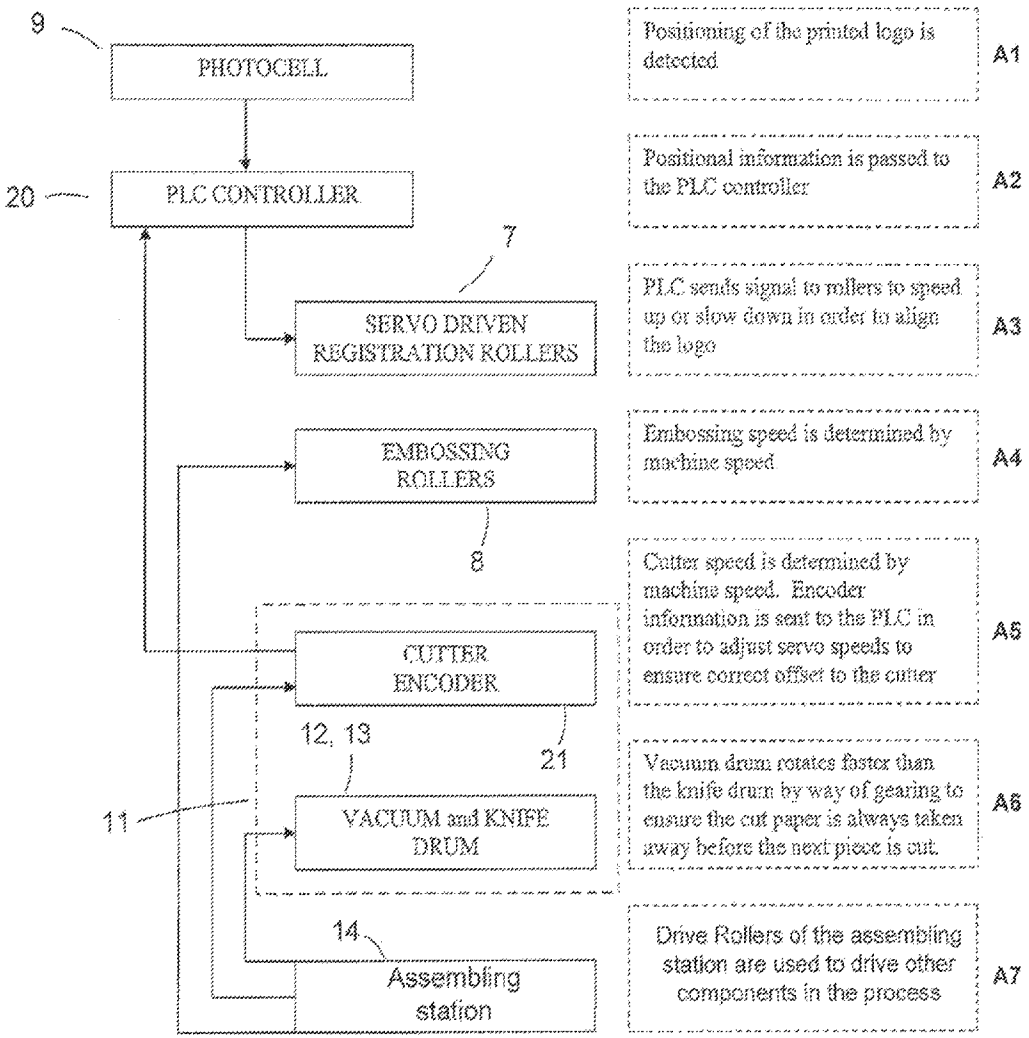
FIG. 4 schematically illustrates elements of an apparatus and method for making a smoking article.

FIG. 4 schematically illustrates functional elements of the cigarette nothing machine 1. Referring to FIG. 4, the position of a printed logo on the tipping paper is detected by the photocell 9, as shown in block A1. The positional information is passed to programmable logic controller (PLC) 20, as shown in block A2. The PLC 20 sends signals to the registration rollers 7 to speed up or slow down in order to bring the logo into register with the embossed pattern formed by the embossing rollers 8, as shown in block A3. The embossing speed is determined by the machine speed, as shown in block A4. The cutting unit 11 may include a cutter encoder 21. Cutting encoder information is sent to the PLC 20 in order to adjust servo speeds to ensure correct offset to the cutter 11, as shown in block A5. The vacuum drum 13 rotates faster than the knife drum 12 by way of gearing to ensure that each segment 5*a*, 5*b* etc of the cut tipping paper is always taken away before the next segment is cut, as shown in block A6. The drive rollers of the assembling station 14 are used to drive other components in the process, as shown in block A7. Therefore, the cigarette assembly station 14 may determine the embossing speed and the cutter speed.

Figure 5:
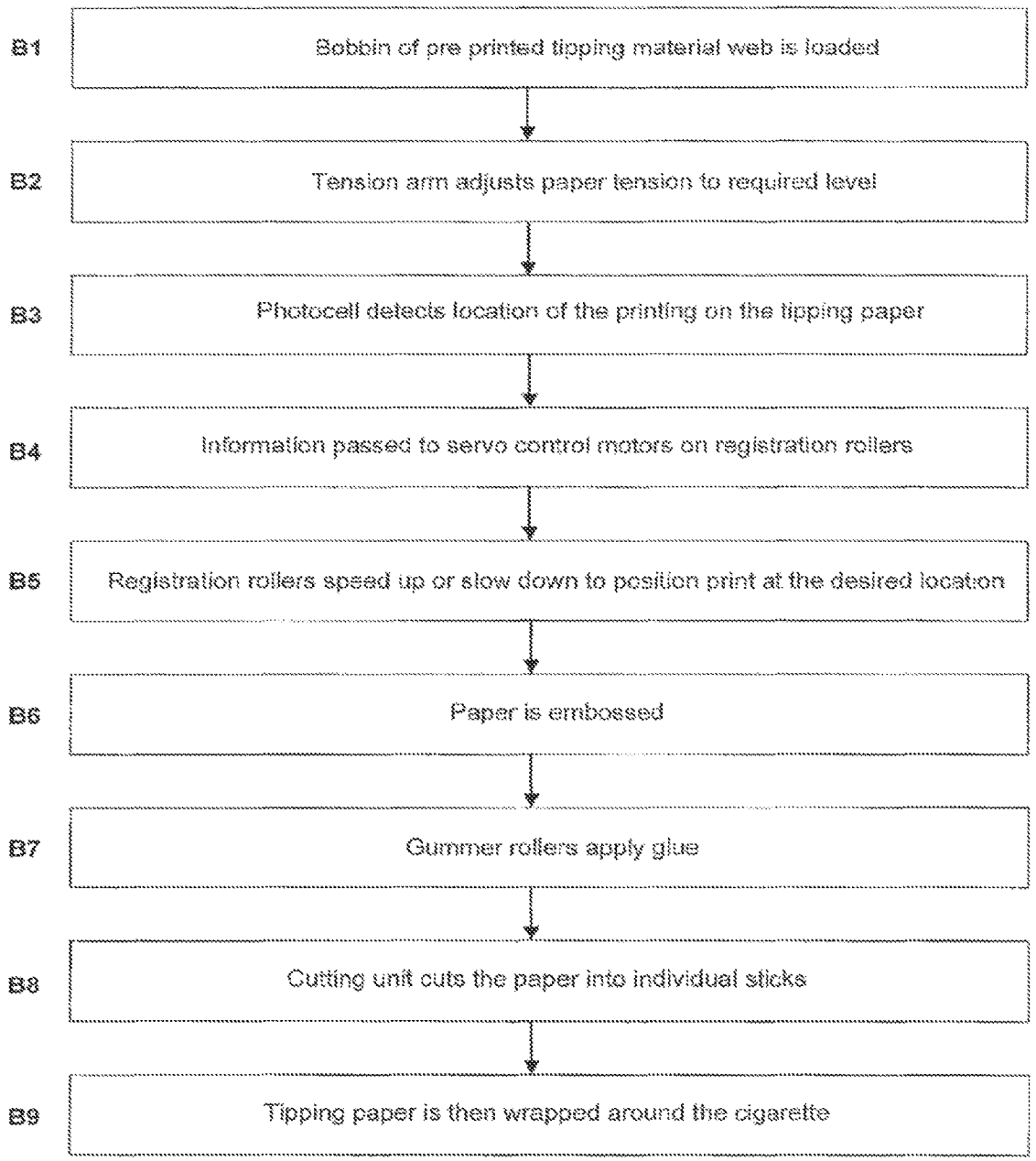
FIG. 5 illustrates a method of making a smoking article.

Operation of an apparatus for making a smoking article is described in FIG. 5.

In step B1, a bobbin of pre-printed tipping material web is loaded onto the holder 1.

In step B2, the tension arm 6 adjusts paper tension in the ribbon 5 to a required level.

In step B3, the photocell 9 detects the location of a printing on the tipping paper.

In step B4, the location information is passed to the servo control motors of the registration rollers 7.

In step B5, the registration rollers 7 speed up or slow down and position each printed logo on the ribbon at a required location relative to the embossing head 8.

In step B6, the paper ribbon 5 is embossed in register with the pre-printed logo.

In step B7, the gummer rollers 10 apply glue to the ribbon.

In step B8, the cutting unit 11 cutes the paper into individual segments.

In step B9, the segment of the cut tipping paper 5 is wrapped around the cigarette or cigarette pair.

The cigarette making machine 1 may be electronically controlled by means of a control lop. The control loop process is graphically described in FIGS. 6-9. The control loop process shown in FIGS. 7-9 is a multi-threaded process.

The printed logo on the ribbon 5 may be initially registered in relation to the embossing rollers 8 upon start-up of the machine and a continuous feedback process may then be used to ensure that the print remains within tolerance. If a print is found to be outside of the tolerance range then a message may be sent to an appropriate part of the cigarette making machine to reject this cigarette at a later stage. It may be determined whether the print is within tolerance, or whether the print is too advanced, or lagging, by detecting the position of the print using the photocell 9.

The control process also flags up errors that have occurred with the photocell on machine start up. In particular, any errors that have occurred with the photocell on machine start up which deem the machine incapable of registering print may be flagged up. This is performed by means of a machine function test. The machine function test includes a step of moving the paper ribbon 5 along a certain distance and a step of determining whether the photocell 9 has recognised and responded to the resulting change in conditions.

The printed paper may be registered to an emboss and to the lap seam of the tipping paper via an encoder on the cigarette making machine or maker to ensure that the emboss does not occur on the lap seam and that both the emboss and the print are a certain distance away from the edge of the paper.

The control process also functions to re-align the printed pattern on the tipping paper to the embossed pattern formed by the embossing rollers by either pulling back on the paper or accelerating the paper forward incrementally. As described hereinabove, an embossing roller may have a pre-positioned non-embossing region such that the embossing roller does not make contact with the paper when the rotational position of the embossing roller is within a predetermined range. Thus, the print pattern can be adjusted relative to the embossed pattern formed by the embossing roller by pulling back on the paper or accelerating the paper forward incrementally when the embossing rollers are not embossing.

The position of the paper is continuously fed back into the system, and movements are made when the print is out of tolerance and when the print is within tolerance but is still deemed not directly in line with the emboss.

The value of X is shared amongst the processes described in FIGS. 7-9, i.e., the Photocell function test, Lagging print and Advanced print. The value of X represent the number of errors which have occurred in a row. Since the value of X is shared between all of the processes shown in FIGS. 8-10, the total number of errors is counted, and not just one type of error. Once a predetermined number of consecutive errors Ω have occurred, the machine is stopped. Accordingly, the machine is stopped when X is greater than Ω.

The value x designates the tolerance in mm that the print must be within for a cigarette to be accepted.

Figure 6:
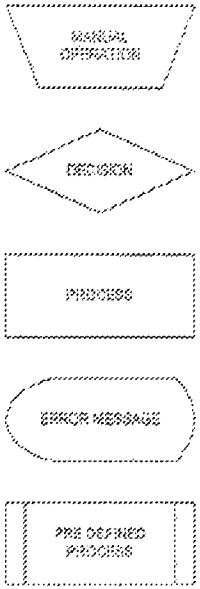
FIG. 6 illustrates a key showing the correspondence between the shapes of the elements used in FIGS. 7-9 and the type of operation represented by the shape.
Figure 7:
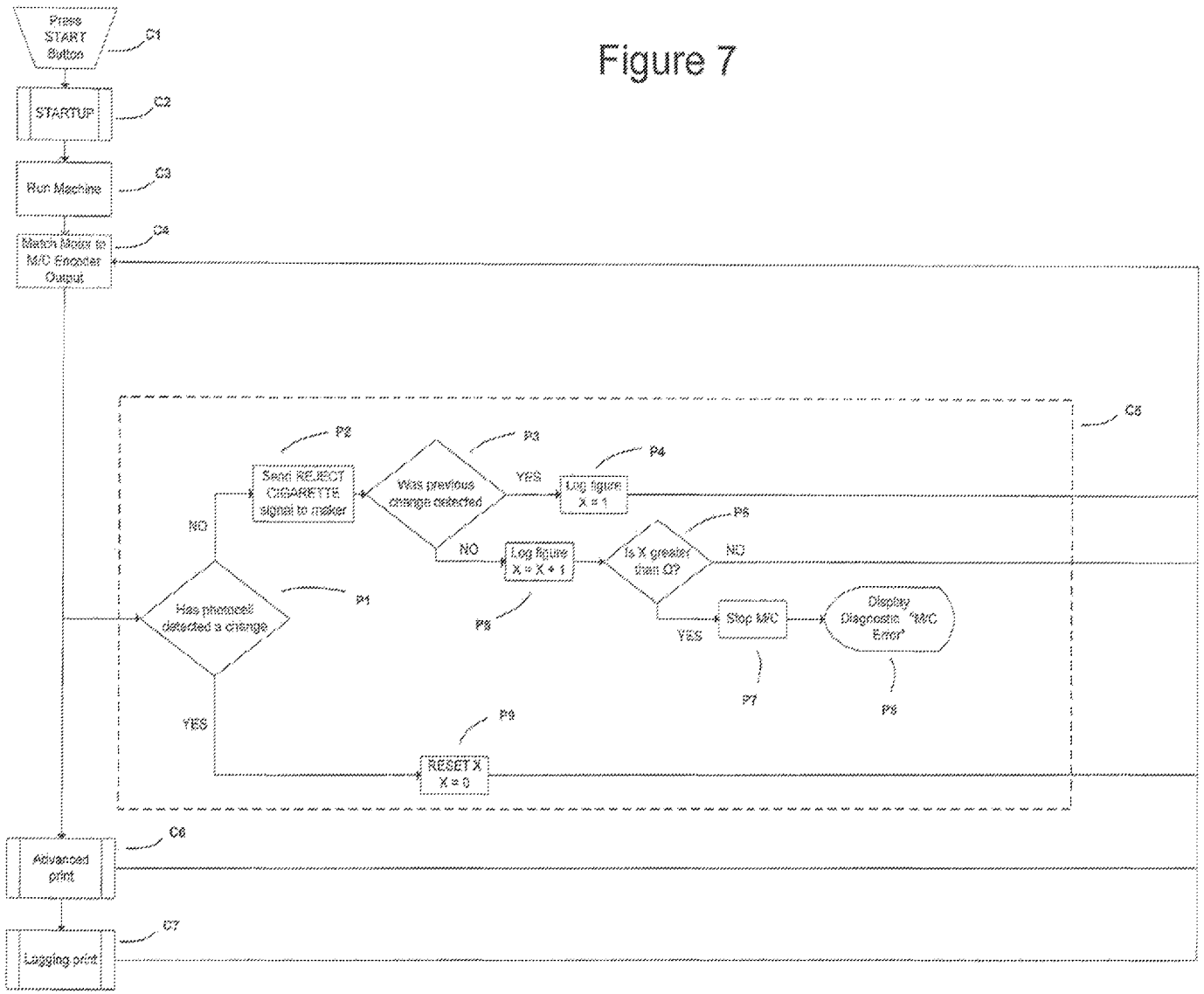
FIG. 7 illustrates control loop process for controlling a cigarette maker showing detail of photocell function test.
Figure 8:
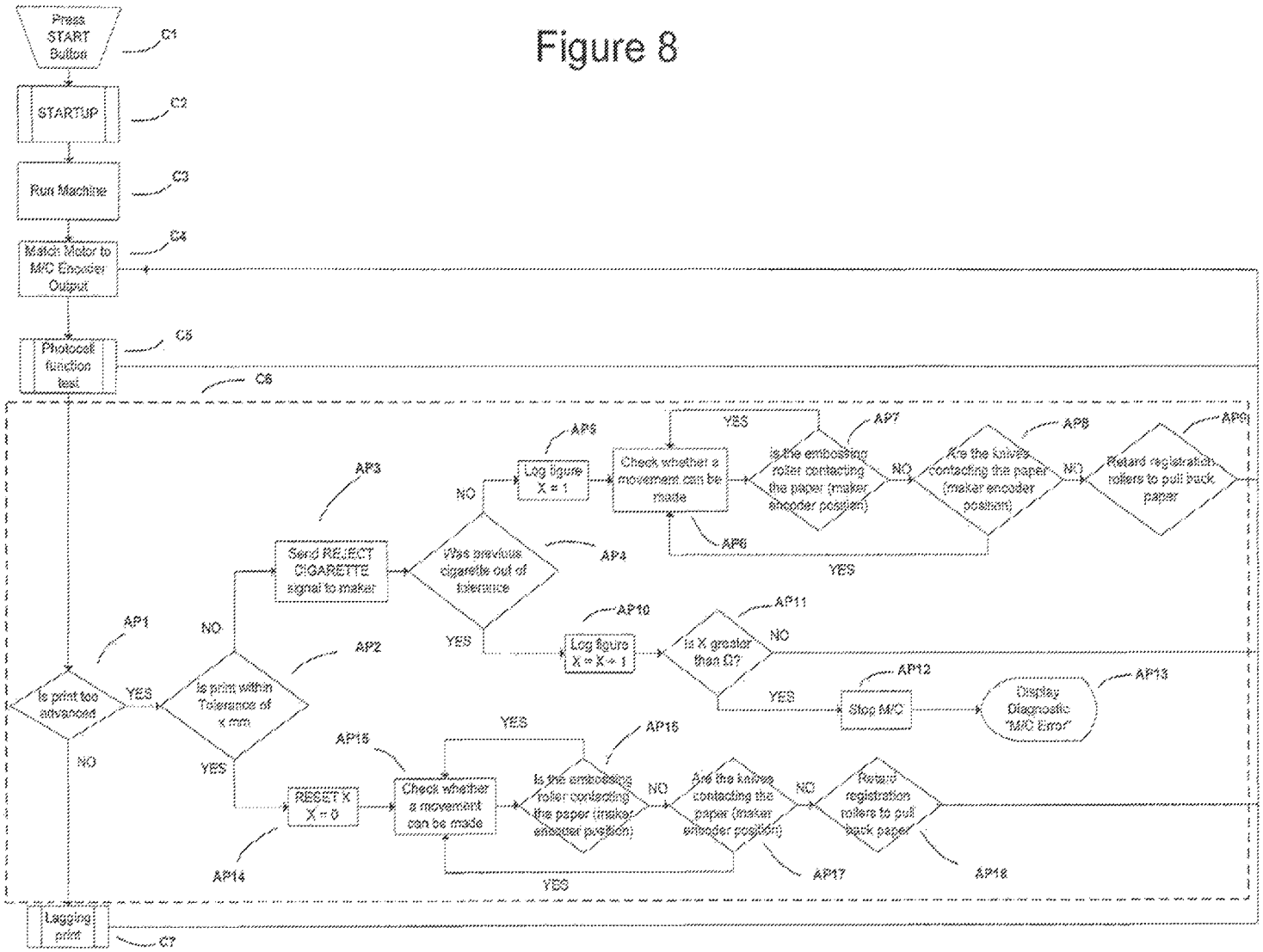
FIG. 8 illustrates control loop process for controlling a cigarette maker showing detail of an advanced print process.
Figure 9:
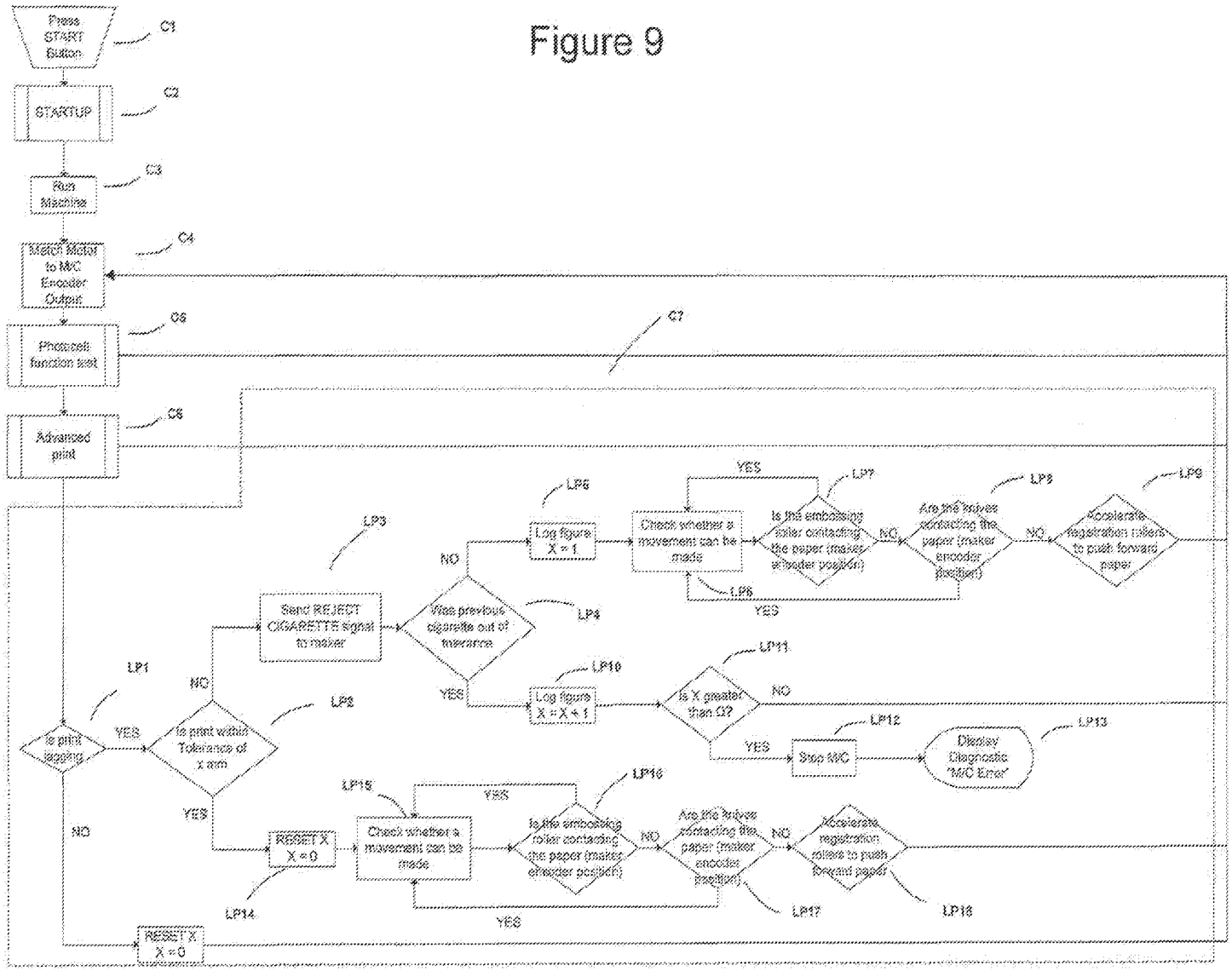
FIG. 9 illustrates control loop process for controlling a cigarette maker showing detail of an lagging print process.

FIG. 6 shows a key which illustrates the correspondence between the shapes of the elements used in FIGS. 7-9 and the type f operation represented by the shape. For example, as shown in FIG. 6, a trapezoidal element represents a manual operation, an element in the shape of a rhombus represents a decision and an element in the shape of a rectangle represents a process.

FIGS. 7, 8 and 9 show schematics of the control loop. In manual operations C1, the user presses the start button to start the control process. As shown in block C2, a startup process is then run. The cigarette maker is then run, as shown in block C3. In block C4, the motor of the embossing roller speed is matched to the output of an encoder on the maker. That is, the embossing roller speed is matched to the machine speed. In block C5, a photocell function test process is run. In step C6, an advanced print process is run. In step C7, a lagging print process is run.

The photocell function test C5 is shown in more detail in FIG. 7. The photocell function test flags up and notifies the user of errors which occur with the photocell.

In step P1 of the photocell function test C5, it is determined whether the photocell has detected a change. If the photocell has not detected a change, a REJECT CIGARETTE signal is sent to the maker, as shown in clock P2, and the present cigarette is rejected.

In step P3 it is determined whether the previous change was detected by the photocell. If the previous change was detected, the value of X is set to 1. This step is represented in block P4 as "log figure X=1". If the previous change was not detected, the value of X is increased by 1 and the new value is stored. This step is represented in block P5 as "log figure X=X+1".

In step P6, it is determined whether X is greater than Ω, where Ω is a predetermined number.

If the value of X exceeds Ω, the machine is stopped, as shown in block P7 and a "M/C Error" message is displayed, as shown in block P8. Thus, the method stops the machine if the number of errors which have occurred in a row is excessive. If the photocell has detected a change, the value of X is reset to zero, as shown in block P9.

The advanced print process C6 is shown in more detail in FIG. 8.

In step AP1, it is determined whether the print is too advanced. If the print is too advanced, it is determined whether the print is within tolerance of x mm, as shown in block AP2. x is a predetermined tolerance value. If the print is not within tolerance of x mm, a REJECT CIGARETTE signal is sent to the maker, as shown in block AP3, and the instant cigarette is rejected.

In block AP4, it is determined whether the previous cigarette was out of tolerance. If the precious cigarette was not within tolerance, the value of X is set to 1. This step is represented in block AP5 as "log figure X=1". In step AP6, it is checked whether movement can be made. As shown in block AP7, it is then determined whether the embossing roller is contacting the paper. If the embossing roller is not contacting the paper, it is determined whether the knives are contacting the paper, as shown n block AP8. If none of the conditions of steps AP7 or AP8 are true, the registration rollers are retarded in order to pull back the paper, as shown in block AP9.

If the previous cigarette was out of tolerance, the value of X is increased by 1 and the new value is stored. This step is represented in block AP10 as "log figure X×X+1". In step AP11, it is determined whether X is greater than Ω. If X is greater than Ω, the machine is stopped, as shown in block AP12, and an "M/C Error" message is displayed, as shown in block AP13.

If the print is within tolerance is x mm, the value of X is reset to zero, as shown in block AP14. It is then checked whether movement can be made, as shown in block AP15. As shown in block AP16, it is then determined whether the embossing roller is contracting the paper. If the embossing roller is not contracting the paper, it is determined whether the knives of the cutting unit are contacting the paper, as shown in block AP17. If none of the conditions of steps AP16 or AP17 are true, the registration rollers are retarded in order to pull back the paper, as shown in block AP18.

The lagging process C7 is shown in more detail in FIG. 9.

As shown in FIG. 9, in step LP1, it is determined whether the print is lagging. If the print is lagging, it is determined whether the print is within tolerance of x mm, as shown in block LP2, x is a predetermined tolerance value. If the print is not within a tolerance of x mm, a REJECT CIGARETTE signal is sent to the maker, as shown in block LP3, and the instant cigarette is rejected.

In block LP4, it is determined whether the previous cigarette was out of tolerance. If the previous cigarette was not within tolerance, the value of is set to 1. This step is represented in block LP5 as "log figure X=1". In step LP6, it is checked whether movement can be made. As shown in block LP7, it is then determined whether the embossing roller is contracting the paper. If the embossing roller is not contacting the paper, it is determined whether the knives are contacting the paper, as shown in block LP8. If none of the conditions of steps LP7 or LP8 are true, the registration rollers are accelerated in order to push forward the paper, as shown in block LP9.

If the previous cigarette was out of tolerance, the value of X is increased by 1 and the new value is stored. This step is represented in block LP10 as "log figure X=X+1". In step LP11, it is determined whether X is greater than Ω. If X is greater than Ω, the machine is stopped, as shown in block LP12, and an "M/C Error" message is displayed, as shown in block LP13.

If the print is within tolerance of x mm, the value of X is reset to zero, as shown in block LP14. It is then checked whether movement can be made, as shown in block LP15. As shown in block LP16, it is then determined whether the embossing roller is contacting the paper. If the embossing roller is not contacting the paper, it is determined whether the knives of the cutting unit are contacting the paper, as shown in block LP17. If none of the conditions of steps LP16 or LP17 are true, the registration rollers are accelerated in order to push the paper forward, as shown in block LP18.

It will by appreciated that the invention also includes many variations of the above described apparatuses and methods for making smoking articles.

For example, as described above, sections of the tipping paper may be embossed with a patter such as a pattern comprising logos. Alternatively, the whole tipping paper, substantially the whole tipping paper, or the portion of the tipping paper which is ultimately visible on the cigarette may be embossed. Embossing the tipping paper in this fashion can be referred to as an "all-over emboss", and the embossed pattern can be referred to as an "all-over emboss" pattern.

Alternatively, the tipping paper may be embossed with such an "all-over emboss" pattern and also with a pattern which comprises logos.

Alternatively, the tipping paper may be pre-embossed with a first pattern, and a second pattern may be embossed onto the tipping paper. The first pattern may, for example, be an "all-over emboss" embossing pattern.

Figure 10:
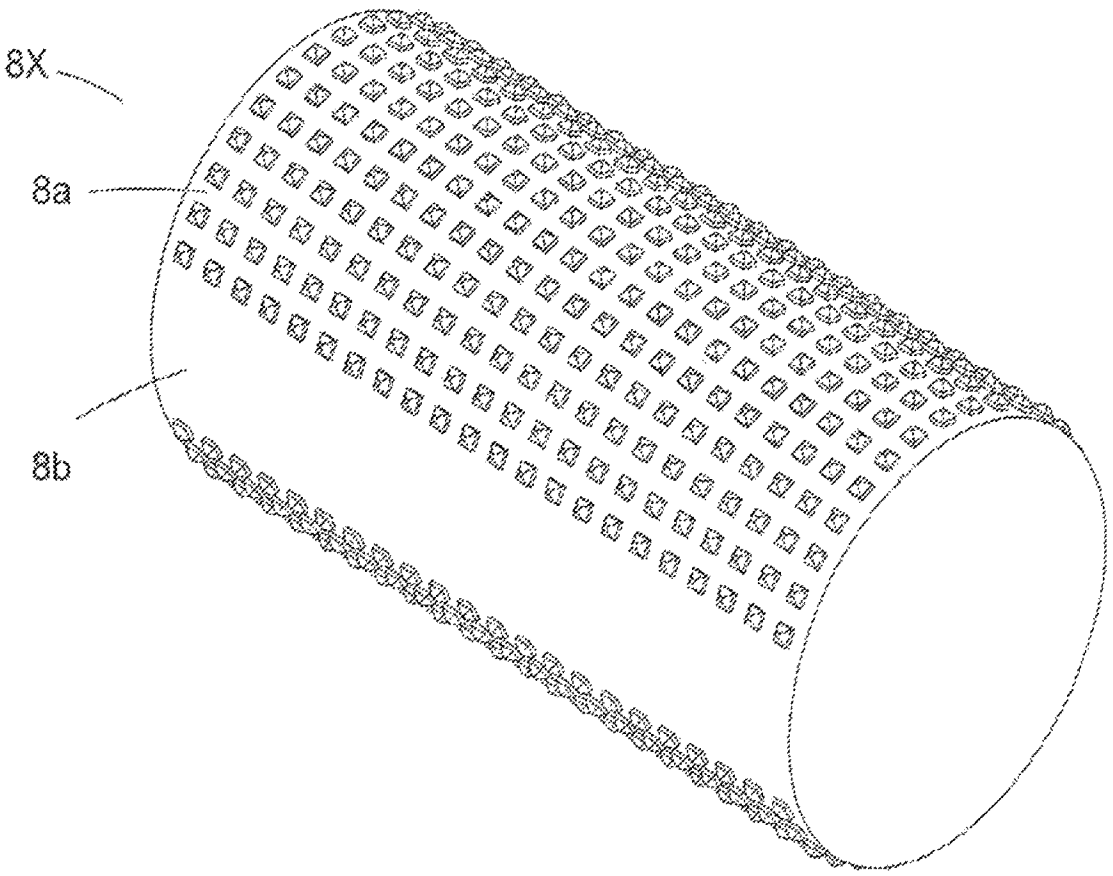
FIG. 10 shows an embossing roller having a section which does not emboss.

FIG. 10 shows an embossing roller 8X suitable for transferring an all-over embossing pattern to the tipping paper. The embossing roller 8X has an embossing section 8*a* and a section which does not emboss 8*b*. As shown, and as is described in more detail hereinabove, the section which does not emboss 8*b* is arranged such that is does not contact the tipping paper 5 during rotation of the roller 8X. Although the section which does not emboss is graphically described with reference to an embossing roller suitable for transferring an all-over embossing pattern, it would be clear to the skilled person that the section which does not emboss 8*b* shown in FIG. 3 could be employed on any embossing roller, and therefore could, for example, be employed on a embossing roller suitable for embossing logos onto tipping paper.

Furthermore, instead of having a section which does not emboss, the embossing rollers may be lifted or halted such that the print pattern may be positioned relative to the embossed pattern formed by the embossing unit.

As described above, the section which does not emboss may not contact the tipping paper during rotation of the roller. Alternatively the section which does not emboss may make contact with the tipping paper. In this case, the tipping paper may slide through the section which does not emboss independently of the rotation of the embossing roller. Alternatively, or in addition, the section which does not emboss may be arranged such that the tipping paper may slide through the section which does not emboss without causing the embossing rollers to rotate.

Furthermore, when the tipping paper is wrapped around the double length filter, a first region of the tipping paper segment may overlap with a second region of the tipping paper segment. The machine 1 may be configured so that the region of the tipping paper which is not embossed due to the non-embossing section 8*a* is in register with the second region of the tipping paper. Thus, the non-embossed section of the tipping paper can be hidden from view and an all-over emboss can be achieved.

Still further, instead of manufacturing pairs of cigarettes, the machine may be configured to manufacture cigarettes one by one. That is, the assembling station may, alternatively, be configured to assemble the smoking article by joining a single length filter to the rod of smokeable material by wrapping the filter at least partially with tipping paper which has been embossed in a suitable way.

Still further, the cutter may be configured to cut the tipping paper such that each repeated sub-pattern is cut in the same place. That is, the cut times of the cutter may be registered with the pattern on the tipping paper.

The cutter and the embossing unit may be driven by the same drive, or may be driven by different drives.

The logos on the tipping paper may by longitudinally separated such that the tipping paper of each assembled cigarette has one or more complete logos. For example, the longitudinal separation between the logos may be the circumference of a cigarette so that a single complete logo is formed on the tipping paper of each assembled cigarette.

Still further, instead of using pre-printed sheet material the apparatus may comprise a printing unit for printing a pattern on the sheet material.

Furthermore, a photo-resistor, a photodiode, a charge coupled device, or any other light detecting means may be used to detect the position of the pattern on the tipping paper.

Furthermore, the embossing position may be determined in dependence on a first position of the tipping paper. The first position of the tipping paper may be determined by detecting a position of the print pattern on the tipping paper, or by other means. For example, the first position of the tipping paper may be detected by mechanical means, or by optical means.

Furthermore, punch or stamp type embossing means, or any other means for forming an embossed pattern on the tipping paper may be used in place of embossing rollers.

Still further, the conveying means may comprise feed or drive rollers which include motors such as servo-motors. The conveying means also comprise guide rollers which may not be driven.

Still further, the embossing position may be determined in dependence on a first cut time of the cutting unit 11, the first cut time being determined in dependence on a position of the print pattern. Therefore, the controller may synchronise a cut time associated with the print pattern with a cut time associated with the embossed pattern, and thereby bring the embossed pattern and the print pattern into register.

Still further, instead of holding tipping paper, the holder may hold a different sheet material. For example, the holder may hold paper wrapper suitable for wrapping around the rod of smokeable material. The embossing unit may be configured to emboss paper wrapper drawn from the holder. The assembling station may be configured to wrap the embossed paper wrapper around the tobacco rod.

The above embodiments or alternative may be used either singly or in combination to achieve the effects provided by the invention.

Many further modification and variations will be evident to those skilled in the art, that fall within the scope of the following claims:

The invention claimed is:

1. An apparatus for making a smoking article having a rod of smokeable material and a cylindrically wrapped layer of tipping paper, the apparatus comprising:

a holder for holding the tipping paper;

an embossing unit configured to emboss tipping paper drawn from the holder, the embossing unit comprising first and second embossing rollers arranged to form an embossed pattern on the sheet material as it is passed between the rollers, the first embossing roller having a non-embossing portion;

a controller which determines an embossing position of the tipping paper such that a print pattern on the sheet material and the embossed pattern are in register;

a positioning unit which positions the sheet material in the embossing position when the non-embossing portion of the first embossing roller faces the second roller, and an assembling station for assembling the smoking article, configured to receive embossed tipping paper from the embossing unit and to assemble the smoking article, wherein assembling the smoking article comprising joining a filter rod to the rod of smokeable material by wrapping the filter rod at least partially with the embossed tipping paper; and wherein the embossing unit comprises embossing rollers fitted in place of pulling rollers of a conventional machine.

2. The apparatus according to claim 1, wherein the assembling station is configured to assemble a pair of smoking articles, each having a rod of smokeable material, by:

joining the filter rod to the pair of rods of smokeable material by wrapping the filter rod at least partially with the embossed tipping paper and cutting the wrapped filter rod.

3. The apparatus according to claim 1, wherein the positioning unit comprises a registration roller driven by a motor.

4. The apparatus according to claim 1, further comprising a detector for detecting a position of the print pattern and wherein the controller is configured to determine the embossing position in dependence on the detected position of the pattern.

5. The apparatus according to claim 1, wherein the tipping paper is wrapped around the filter rod such that a first region of the tipping paper overlaps with a second region of the tipping paper; and wherein the section which does not emboss is arranged such that the embossing unit does not form an embossed pattern on the second region.

6. The apparatus according to claim 1, wherein the controller is configured to send a signal to the positioning unit and thereby control the positioning unit to position the tipping paper in the embossing position.

* * * * *